United States Patent [19]

Gross

[11] Patent Number: 5,004,196

[45] Date of Patent: Apr. 2, 1991

[54] KEYBOARD ACCESSORY

[75] Inventor: Clifford Gross, Deer Park, N.Y.

[73] Assignee: Biomechanics Corporation of America, Melville, N.Y.

[21] Appl. No.: 436,704

[22] Filed: Nov. 15, 1989

[51] Int. Cl.[5] ..... A47F 7/100

[52] U.S. Cl. ..... 248/118.3; 248/918; 400/715

[58] Field of Search ..... 248/118, 118.1, 118.3, 248/118.5, 918, 316.5, 225.1, 298, 287, 297.3; 400/715

[56] References Cited

U.S. PATENT DOCUMENTS

| | | | |
|---|---|---|---|
| 432,786 | 7/1890 | Brandt | 248/118.3 |
| 481,293 | 8/1892 | Bailey et al. | 248/287 |
| 1,277,169 | 8/1918 | Anderson | 248/118.3 |
| 1,407,174 | 2/1922 | Simpson | 248/297.3 X |
| 1,801,669 | 4/1931 | Hintz et al. | 400/715 |
| 2,703,265 | 3/1955 | Wolfe | 248/287 X |
| 2,766,463 | 10/1956 | Bendersky | 248/118 |
| 4,621,781 | 11/1986 | Springer | 248/118 |
| 4,688,862 | 8/1987 | Fowler et al. | 400/715 X |
| 4,913,390 | 8/1990 | Berke | 248/118.3 X |

FOREIGN PATENT DOCUMENTS

| | | | |
|---|---|---|---|
| 1913287 | 9/1970 | Fed. Rep. of Germany | 400/715 |
| 2430036 | 1/1976 | Fed. Rep. of Germany | 400/715 |

*Primary Examiner*—Alvin C. Chin-Shue

*Attorney, Agent, or Firm*—Leonard Bloom

[57] ABSTRACT

A pad support for each wrist of a keyboard operator which is adjustable vertically, transversely and in pivotal traverses relative to the keyboard to minimize unsupported wrist and arm movements of the operator that contribute to fatigue and possible physical injury, such as Carpal Tunnel Syndrome.

11 Claims, 3 Drawing Sheets

10
14
28
6

20
88
92
56
14'
104
54
92
88
4
18
42
36
34
38
40
6
10

20
70
106
118
86
82
90
52
56
68
96
98
104
102
54
62
96
106
90
52
18
64
86
82
98
34
16

KEYBOARD ACCESSORY

The present invention relates generally to improvements for keyboard operators, and more particularly to wrist supports for such operators which contributes to user comfort and obviates the cumulative negative effects of the repetitious movements in the wrists and arms of the operator that otherwise might cause physical injury as well as cause operator fatigue.

In many organizations, wrist injury has become a major occupational health problem. An example is Carpal Tunnel Syndrome (CTS) one of the most frequently occurring cumulative injuries of the wrist. The carpal tunnel is a narrow fibrous tunnel, which is located on the palmar aspect of the wrist between the distal wrist flexion crease and, roughly, the center of the ulnar border of the thenar muscle mass.

Ten structures pass through the canal—four flexor superficialis tendons (flexor digitorum profundus tendons), the flexor pollicis longus tendons and the median nerve. The median nerve contains fibers from C5 to T1 spinal nerves with contributions from the upper, middle, and lower trunks of the brachlal plexus. A part of the lateral and the medial brachial plexus cord combine to form the median nerve. The median nerve passes through the carpal tunnel as it supplies the hand. Distal to the carpal tunnel, the median nerve supplies a motor branch to the thenar muscles, flexor pollicis, and opponens pollicis muscles. Motor branches also supply the lateral head of adductor pollicis and the lumbriacal muscles of the index and middle fingers.

Underlying the present invention is the recognition that repetitive and forceful flexion or extension movements of the wrist will gradually damage the median nerve in its narrow canal and lead to the increase of carpal canal pressure either by decreasing the diameter or by increasing the volume of contents of the tunnel. The use of the within inventive keyboard accessory has been found in practice to obviate Carpal Tunnel Syndrome in keyboard operators.

EXAMPLES OF THE PRIOR ART

In the U.S. Pat. No. 360,529 issued to Jurey on Apr. 5, 1887, the wrists of a keyboard operator are projected through support loops C, supported from above on a frame A, and while supporting the weight of the wrists the provided loops are uncomfortable, and to the extent that they resemble "shackles" are undesirable for modern usage.

In U.S. Pat. No. 591,800 issued to Finnblade et. al. on Oct. 12, 1897, wrist supports for a piano player are arranged for sliding mvoement on a transverse bar "d", but otherwise the individual wrist supports have no other degrees of movement, such as vertically ascending and descending movements, pivotal movements, or rotative movements, although position adjustments in the bar "d" are contemplated to partially overcome this shortcoming.

An object of the present invention is to provide universally positionable keyboard operator wrist supports overcoming the foregoing and other shortcomings of the prior art, and more particularly wrist supports of the nature noted in which position adjustments in all the necessary degrees of movement or orientation to the keyboard are readily provided using constructions that are noteworthy by their simplicity and operating mode, as well as providing other benefits and advantages as will be better understood as the description proceeds.

The description of the invention which follows, together with the accompanying drawings should not be construed as limiting the invention to the example shown and described because those skilled in the art to which this invention appertains will be able to devise other forms thereof within the ambit of the appended claims.

Figure 1:
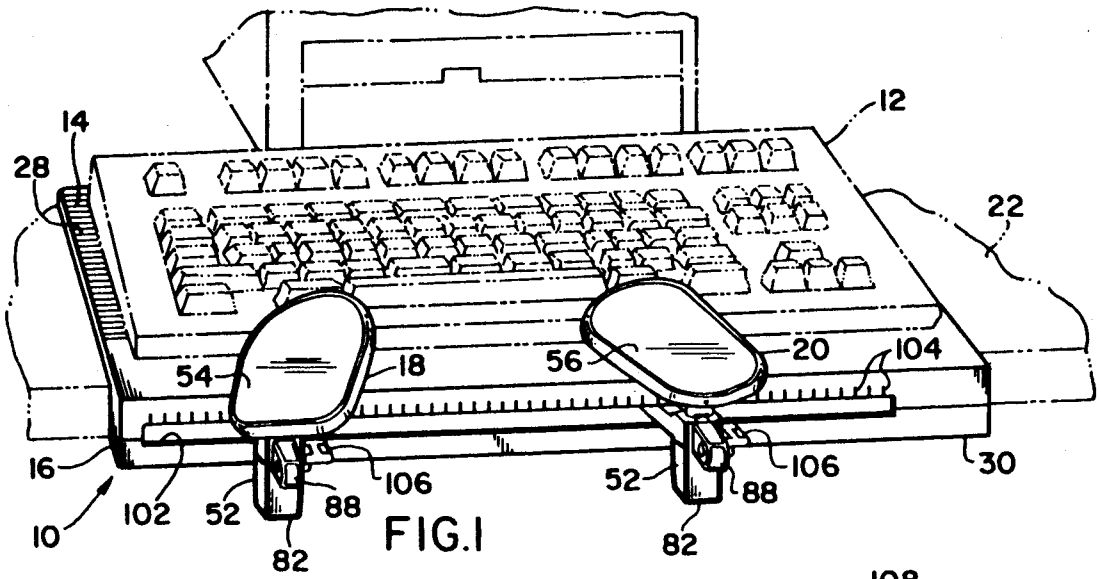
FIG. 1 is a perspective view of the within inventive wrist support and of its operative position in relation to a keyboard shown in phantom perspective.

The within inventive wrist support, generally designated 10, has the operative position as shown in FIG. 1 in which it is used to overcome the tedium of those that operate computers or other keyboard controled equipment for extended periods, and to achieve this end is located along the front of the keyboard 12.

Figures 2, 3:
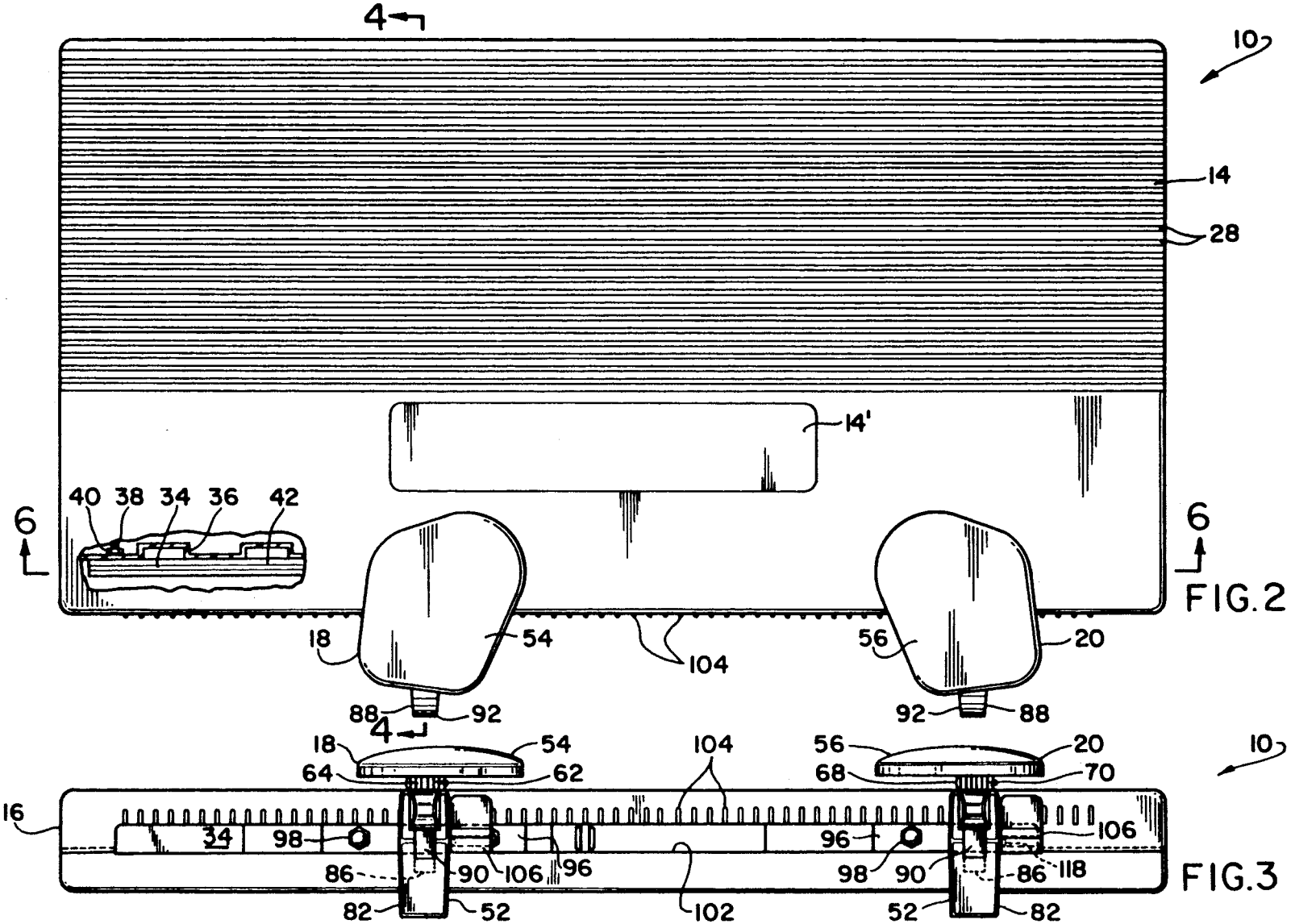
FIG. 2 is a plan view of the wrist support.
FIG. 3 is a front elevational view thereof.

Support 10 is comprised generally of a rectangular platform 14 which has a housing 16 along its forward edge. A section 14' of panel 14 beneath the keyboard 12 may be reserved for operator instructions, as shown in FIG. 2. Protruding from housing 16 are a left wrist support 18 and right wrist support 20, the construction and operation of which will be subsequently described in detail. Platform 14 and housing 16 are designed to fit on the edge of a desk or table 22. Platform 14 optionally can have keyboard 12 merely resting on it, as shown, or it can be attached to keyboard 12, or it can be made integral with keyboard 12. Support 10 is adapted to be secured by Velcro strips 24 which allign with Velcro patches 26 adhesively attached to surface 22 to retain its illustrated operative position. A ribbed surface 28 on platform 14 assists in the positioning of the keyboard 22. To provide the front slot 102 of the support the lower part 30 of housing 16 is secured by screws 32, as seen in FIG. 4.

Figure 6:
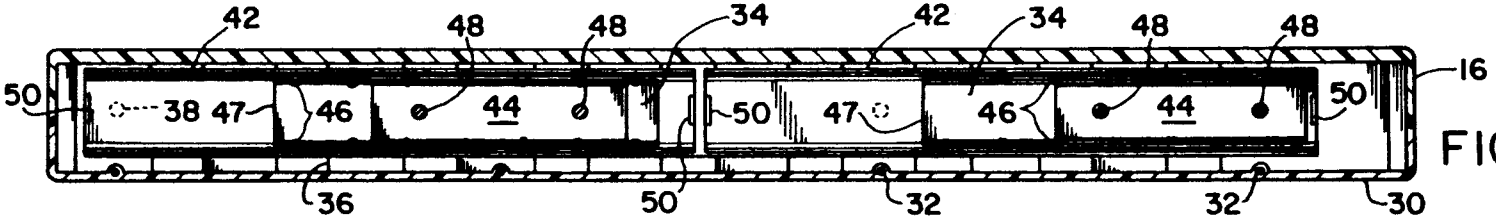
FIG. 6 is a front view in section taken along line 6—6 of FIG. 2.
Figures 4, 5:
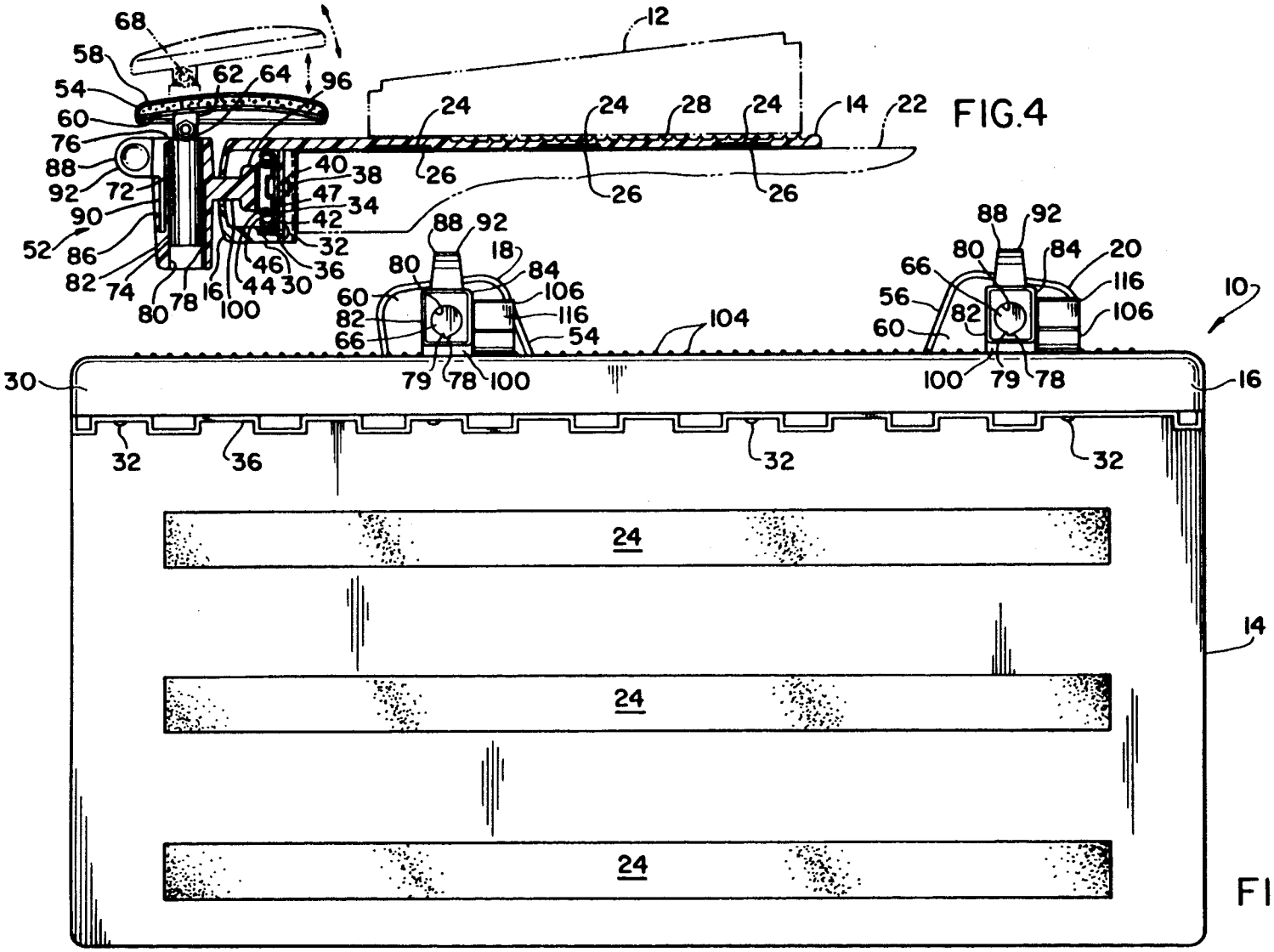
FIG. 4 is a side view in section taken along line 4—4 of FIG. 2.
FIG. 5 is a bottom view of the wrist support.

Within housing 16, and as best seen in FIGS. 4 and 6, the means for mounting the left and right supports 18, 20 for sliding movement, includes a pair of glide assemblies 34 that are each fastened to a corrugated rear wall 36 by threaded studs 38 and nuts 40. Each assembly 34 has an outer ball bearing race 42 which is stationary while an inner movable ball bearing race carriage 44 is supported on captive ball bearings 46. Ball bearings 46 are held in a retainer 47 by being seated in a cooperating opening smaller than the diameter thereof, and thus in a conventional well understood manner. Each carriage 44 is made to have a pair of threaded studs 48 thereon. The sliding traverse of each carriage 44 is limited by end stops 50 on the stationary race 42.

Figure 7:
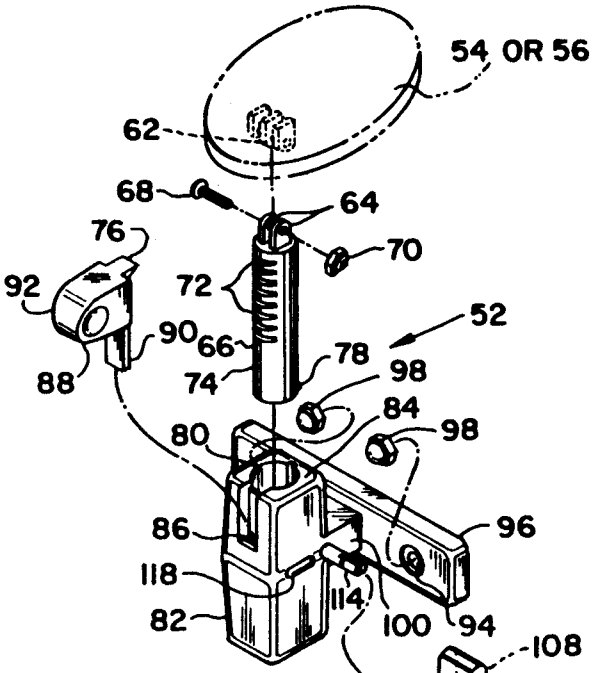
FIG. 7 is a perspective view of the main components of the wrist support in disassembled relation to better illustrate the cooperative relation therebetween.

Attached to each carriage 44 is a wrist support assembly 52 for each wrist support 18 and 20. Both assemblies 52 are identically constructed except for the curvature of the left and right wrist pads 54 and 56, which are each made of a foam filled, soft, flexible, plastic cover 58 fitted to a shaped metal plate 60 (FIG. 4). Referring to FIG. 7 in conjunction with FIG. 4, it will be noted that each plate 60 has three hinge leaf extensions 62 on its lower surface that interfit in engaging relation with a pair of similar extensions 64 on support post 66. Extensions 62 and 64 allow for pivotal movement except when frictionally prevented by a screw 68 and self-locking nut 70. In this manner, screw 68 and nut 70 can be tightened to lock pads 54 and 56 in any position, or untightened to give a degree of pivotal freedom preparatory to permitting adjustment to another position. Post 66 is provided with a series of notches 72 on its forward face 74 that are engaged by a pawl 76. A detent key 78 on the post rear face 79 limits it only to vertical movement within bore 80 of bracket member 82.

Bracket 82, made of plastic or metal, has a rectangular collar section 84 about bore 80, the forward wall of which is notched, as at 86, to provide a seat for a vertical adjustment member 88 for the post 66. Member 88, made of semi-hard plastic, has a dependent arm 90 which acts as a leaf spring, and thus is normally under spring bias against post 66 and thus normally urges pawl 76 into one of the notches 72. Member 88 is also provided with a finger grip 92 which allows the user to pull member 88 away from post 66, thereby releasing the biasing force of spring 90, such that the released post 66 can be vertically adjusted to correspondingly adjust the position of the left or right wrist pads 54 and 56. After adjustment, release of grip 92 allows member 88 to maintain the selected vertical positions of the pads 54 or 56.

Each collar section 84 is connected by a leg 100 to a mounting panel 96 having holes 94 for receiving therethrough the studs 48 of the ball bearing assemblies 34, which studs are then threadably engaged by cap nuts 98.

From the description provided, it should be understood that left support assembly 18 and right support assembly 20 are designed to be vertically adjustable in the manner noted in connection with FIG. 4, and also to be pivotably adjustable about screw 68 and nut 70, again as also noted in connection with FIG. 4, and to have a degree of movement in which each is readily slidable, left or right, along the ball bearing assemblies 34 within housing 16, as previously noted in connection with FIGS. 3 and 6.

Figure 8:
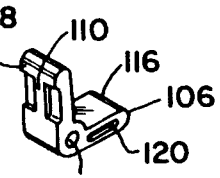
FIG. 8 is an isolated perspective view of one of the FIG. 7 components, namely the clamp members, but as seen from the rear.
Figure 9:
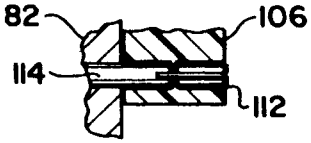
FIG. 9 is a sectional view showing further structural details of the clamp member.

However, there are working conditions, with a number keyboard only, for instance, when the user desires not to have either right or left traversing movements in either wrist support assembly 52. Therefore, above the slot or opening 102 on the front of housing 16, there is provided a series of detents 104 bounding position-locating spaces that are engaged by a clamp member 106 on bracket 82. That is, and as best shown in FIG. 8, a clamp 106, made of semi-rigid plastic, is provided with a contoured face 108 which is dimensioned to have a center section 110 which fits between two adjacent detents 104 on housing 16 to place the clamp member 106 in its locked or positioning mode. Member 106 pivots about a througbore 112 on a cantilever pin 114 which extends from bracket 82. Throughbore 112 and pin 114 are attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A wrist support for a keyboard operator comprising a wrist-supporting member having a pad at its upper end having an operative position in supporting relation beneath said operator's wrist and having connected in depending relation therefrom a cylindrical post, said cylindrical post having a vertical orientation of an array of spaced horizontally oriented notches thereon, a housing having a cylindrical opening to receive in projected relation therein said post, and a spring-biased pawl pivotally mounted on said housing in facing relation to said array of notches and normally biased into contact with said post, whereby the interengagement of said pawl in a selected one of said notches maintains said pad in a corresponding selected vertical position preparatory to use by said operator; including a rectangular support plate having upper and lower edges mounted in bearing means for opposite direction transverse movements, and a leg connected in spanning relation between said bracket and said support plate to additionally impart said transverse movements to said pad incident to the positioning thereof.

2. A keyboard operator's wrist support as claimed in claim 1 including a wall means having a horizontal orientation of an array of spaced apart detent projections thereon along said transverse movement path, and a positioning member pivotally mounted on said bracket of said pad moveable through a pivotal traverse from a clearance position into an operative position projected between a selected adjacent pair of said detent projections to thereby maintain said pad in a selected position of movement along said transverse movement path.

3. A wrist support apparatus to provide support and comfort and to reduce fatigue and possible injury to the wrists of a keyboard operator, the support comprising: a platform having a substantially flat upper surface on which a keyboard is supported, the platform having a front side having a length thereto; at least one wrist support; means for mounting the at least one wrist support on the front side of the platform for sliding lateral movement thereon such that the at least one wrist support may be moved to a desired lateral position with respect to the keyboard; means for vertically adjusting the at least one wrist support to a desired vertical position with respect to the keyboard; and a wrist pad pivotally mounted on the at least one wrist support such that the keyboard operator's wrist may be supported at a desired angular position with respect to the platform; the front side of the platform having a housing mounted thereon, the housing extending downwardly from the platform such that the platform and housing may fit on an edge of a desk, and means to secure the platform to the desk; the housing having therein a slot extending substantially the length of the front side; means within the slot for mounting the at least one wrist support for sliding lateral movement within the slot.

4. The wrist support apparatus of claim 3, wherein two wrist supports are provided to support both wrists of the keyboard operator such that the wrist supports may be spaced apart on the front side of the platform for the comfort of the keyboard operator.

5. The wrist support apparatus of claim 4, wherein the wrist supports each have a first end, the first ends of each wrist support being cambered toward one another such that the wrist supports comfortably support the wrists of the keyboard operator in a normal working position.

6. The wrist support apparatus of claim 3, wherein the wrist pad is substantially flat and has a shape corresponding with the curvature of the key operator's wrist.

7. The wrist support apparatus of claim 3, wherein a soft, flexible cover is fitted to the at least one wrist pad.

8. The wrist support of claim 3, wherein the means for vertically adjusting the wrist support comprises a post having an upper end, a lower end and an intermediate portion, the upper end of the post being connected to the wrist pad, the lower end of the post being slidably received in an opening in a bracket; the intermediate portion of the post having a plurality of spaced apart horizontally oriented notches thereon, a spring-biased pawl pivotally mounted on the bracket in a facing relation to the notches on the post, the pawl being normally biased into contact with the post and engaging a selected notch in the post, such that the post and the wrist pad connected thereto may be moved upwardly and downwardly in the opening in the bracket to a desired position for the comfort of the keyboard operator.

9. The wrist support apparatus of claim 3, wherein the means for mounting the at least one wrist support comprises a stationary outer ball bearing race mounted longitudinally on the housing; an inner movable ball bearing race carriage received in the outer ball bearing race; the at least one wrist support being connected to the inner ball bearing race carriage such that the at least one wrist support may easily slide laterally in the slot on the front of the housing to a desired position with respect to the keyboard.

10. The wrist support apparatus of claim 3, further comprising the slot having a plurality of spaced apart detents thereon; the at least one wrist support having means thereon to engage the detents such that the said wrist support may be retained at a desired lateral position with respect to the keyboard.

11. A wrist support apparatus to provide support and comfort and to reduce fatigue and possible injury to the wrists of a keyboard operator, the support comprising: a platform having a substantially flat upper surface on which a keyboard is supported, the platform having a front side having a length thereto; at least one wrist support; means for mounting the at least one wrist support on the front side of the platform for sliding lateral movement thereon such that the at least one wrist support may be moved to a desired lateral position with respect to the keyboard; means for vertically adjusting the at least one wrist support to a desired vertical position with respect to the keyboard; a wrist pad pivotally mounted on the at least one wrist support such that the keyboard operator's wrist may be supported at a desired angular position with respect to the platform, the wrist pad being substantially flat and having a shape corresponding with the curvature of the key operator's wrist, the wrist pad having a soft flexible cover thereon; wherein the means for vertically adjusting the wrist support comprises a post having an upper end, a lower end and intermediate portion, the upper end of the post being connected to the wrist pad, the lower end of the post being slidably received in an opening in a bracket; the intermediate portion of the post having a plurality of spaced apart horizontally oriented notches thereon, a spring-biased pawl pivotally mounted on the bracket in a facing relation to the notches on the post, the pawl being normally biased into contact with the post and engaging a selected notch in the post, such that the post and the wrist pad connected thereto may be moved upwardly and downwardly in the opening in the bracket to a desired vertical position for the comfort of the keyboard operator; and the front side of the platform having a housing mounted thereon, the housing extended downwardly from the platform such that the platform and housing may fit on an edge of a desk, means to secure the platform to the desk, the housing having therein a slot extending substantially the length of the front side; means within the slot for mounting the at least one arm support for sliding lateral movement within the slot.

* * * * *